US011478801B2

(12) United States Patent
Zeng et al.

(10) Patent No.: US 11,478,801 B2
(45) Date of Patent: Oct. 25, 2022

(54) METHOD FOR SEPARATING CALCITE-RICH LOW-GRADE FLUORITE BARITE PARAGENIC ORE

(71) Applicant: Institute of Multipurpose Utilization of Mineral Resources, CAGS, Chengdu (CN)

(72) Inventors: Xiaobo Zeng, Chengdu (CN); Yaohui Yang, Chengdu (CN); Weiping Yan, Chengdu (CN)

(73) Assignee: INSTITUTE OF MULTIPURPOSE UTILIZATION OF MINERAL RESOURCES, CAGS, CHENGDU (CN)

( * ) Notice: Subject to any disclaimer, the term of this patent is extended or adjusted under 35 U.S.C. 154(b) by 0 days.

(21) Appl. No.: 17/595,853

(22) PCT Filed: Jan. 26, 2021

(86) PCT No.: PCT/CN2021/073693
§ 371 (c)(1),
(2) Date: Nov. 29, 2021

(87) PCT Pub. No.: WO2021/179814
PCT Pub. Date: Sep. 16, 2021

(65) Prior Publication Data

US 2022/0203377 A1 Jun. 30, 2022

(30) Foreign Application Priority Data

Mar. 10, 2020 (CN) ..... 202010161940.4

(51) Int. Cl.
*B03B 9/00* (2006.01)

(52) U.S. Cl.
CPC ..... *B03B 9/00* (2013.01)

(58) Field of Classification Search
CPC ..... B03B 5/28; B03B 5/46; B03B 9/00
(Continued)

(56) References Cited

U.S. PATENT DOCUMENTS 2,686,592 A * 8/1954 Miller ..... B03D 1/00 209/163
3,912,174 A * 10/1975 Karpinski ..... B03B 9/00 241/24.1

(Continued)

FOREIGN PATENT DOCUMENTS

CN 101585016 A * 11/2009
CN 101585016 B 7/2011

(Continued)

OTHER PUBLICATIONS

Conference Secretariat, Collection of the Seventh Annual Report on Mineral Concentration, Mineral Processing Academic Committee of Chinese Society of Metals, 1994, pp. 158.

(Continued)

*Primary Examiner* — Terrell H Matthews
(74) *Attorney, Agent, or Firm* — Bayramoglu Law Offices LLC

(57) ABSTRACT

A method for separating a calcite-rich low-grade fluorite barite paragenic ore, includes the following steps: S1, crushing; S2, performing classification on a crushed ore to obtain a fine-grained ore, a medium-grained ore and a coarse-grained ore; S3, performing jigging gravity separation on the medium-grained ore and the coarse-grained ore to obtain first barite concentrates and jigging tailings; S4, performing color sorting on the jigging tailings to obtain calcite minerals and color sorting tailings; S5, combining the fine-grained ore and the color sorting tailings, and then performing ore grinding to obtain feeding materials in flotation; S6, performing flotation on the feeding materials in flotation to obtain fluorite concentrates and flotation tailings; S7, per- (Continued)

forming chute gravity separation on the flotation tailings to obtain second barite concentrates and chute tailings. The method achieves an effect of obtaining high-quality acid-grade fluorite concentrates ($CaF_2 \geq 98\%$).

15 Claims, 1 Drawing Sheet

(58) Field of Classification Search
USPC ..... 241/24.1
See application file for complete search history.

(56) References Cited

U.S. PATENT DOCUMENTS

| | | | | | |
|---|---|---|---|---|---|
| 4,147,644 | A * | 4/1979 | Wang | B03D 1/008 252/61 |
| 4,720,339 | A * | 1/1988 | Nagaraj | B03D 1/008 209/5 |
| 2014/0255694 | A1* | 9/2014 | Bakke | C22B 26/10 209/552 |
| 2015/0048009 | A1* | 2/2015 | Valerio | B03B 7/00 209/44 |
| 2020/0033316 | A1* | 1/2020 | Long | G01N 33/241 |

FOREIGN PATENT DOCUMENTS

| | | | | | |
|---|---|---|---|---|---|
| CN | 103521344 | A | * | 1/2014 | |
| CN | 103521344 | A | | 1/2014 | |
| CN | 204338316 | U | | 5/2015 | |
| CN | 204338316 | U | * | 5/2015 | |
| CN | 104826738 | A | * | 8/2015 | |
| CN | 104826738 | A | | 8/2015 | |
| CN | 105772214 | A | | 7/2016 | |
| CN | 104826738 | B | | 6/2017 | |
| CN | 107413518 | A | * | 12/2017 | B03B 7/00 |
| CN | 110026286 | A | | 7/2019 | |
| CN | 110026286 | A | * | 7/2019 | |
| CN | 110385197 | A | * | 10/2019 | B03B 9/00 |
| CN | 110385197 | A | | 10/2019 | |
| CN | 111298956 | A | * | 6/2020 | B03B 7/00 |
| CN | 111298956 | A | | 6/2020 | |
| CN | 111921694 | A | * | 11/2020 | B03B 9/00 |
| CN | 110385197 | B | * | 8/2021 | B03B 9/00 |
| KR | 100839589 | B1 | | 6/2008 | |

OTHER PUBLICATIONS

Lihuang Huang, Flotation, Metallurgical Industry Press, 2018, pp. 532.

* cited by examiner

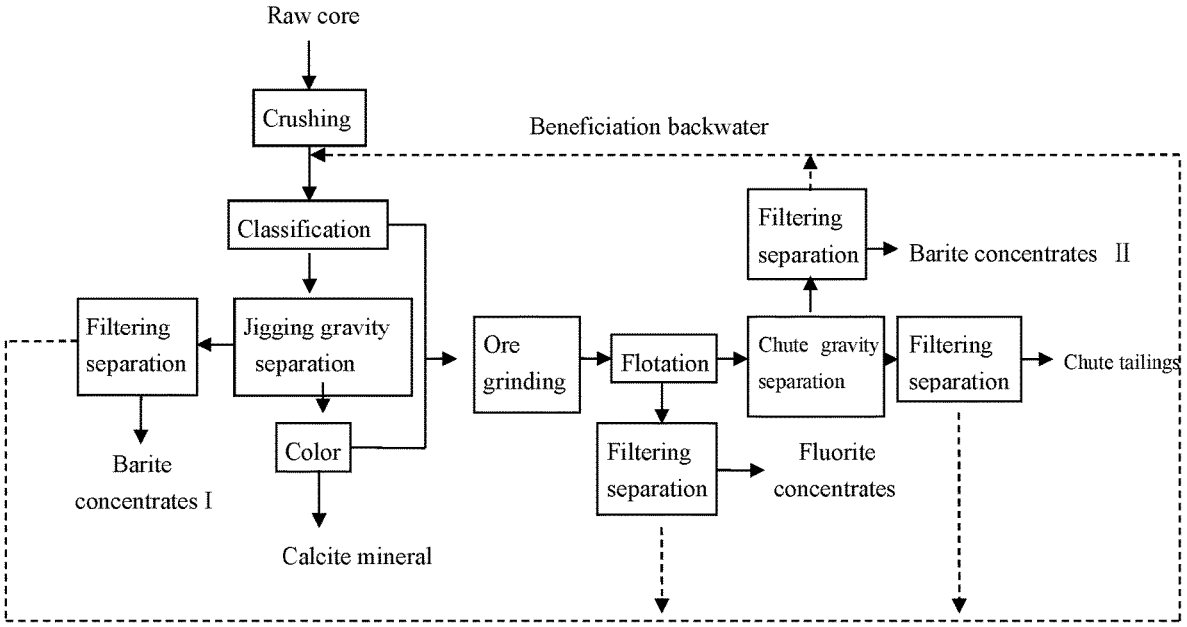
Raw core
Crushing
Beneficiation backwater
Classification
Filtering separation
Barite concentrates II
Filtering separation
Jigging gravity separation
Ore grinding
Flotation
Chute gravity separation
Filtering separation
Chute tailings
Barite concentrates I
Color
Filtering separation
Fluorite concentrates
Calcite mineral

METHOD FOR SEPARATING CALCITE-RICH LOW-GRADE FLUORITE BARITE PARAGENIC ORE

CROSS REFERENCE TO RELATED APPLICATIONS

This application is the national stage entry of International Application No. PCT/CN2021/073693, filed on Jan. 26, 2021, which is based upon and claims priority to Chinese Patent Application No. 202010161940.4 filed on Mar. 10, 2020, the entire contents of which are incorporated herein by reference.

TECHNICAL FIELD

The present invention relates to the technical field of beneficiation of a fluorite barite paragenic ore, particularly to a method for separating a calcite-rich low-grade fluorite barite paragenic ore.

BACKGROUND

Fluorite is a strategically significant non-metallic ore resource, which is used in traditional and emerging industries such as metallurgy, chemical industry, building materials, ceramics, aviation, refrigeration, medicine, atomic energy industry, fluorine chemical industry, etc. Fluorite is listed as an important strategic ore resource in Europe, America and China, and a variety of protective measures have been taken for development and utilization thereof.

At present, more than half of fluorites are used to produce hydrofluoric acid in the world (high-grade fluorite concentrates, generally above acid grade, are necessary in the chemical industry, that is, $CaF_2 \geq 97\%$). The fluorochemical product is one of the basic materials necessary for the high-tech industries. Hydrofluoric acid is the starting point of the fluorine chemical industry chain, and fluorite is the most economical and most critical raw mineral material for producing hydrofluoric acid. Before 2018, China is always a net exporter of fluorite. In recent years, with the continuous development of high-tech industries such as fluorine chemical industry in China, there is an increasing demand for acid-grade refined fluorite powder. In 2018, the import volume of fluorites has reached 510,000 tons in China (mainly acid-grade fluorite concentrates with $CaF_2 \geq 97\%$), which surpassed the export volume for the first time, and China has became a net importer.

Barite is also a very important non-metallic ore resource. Its most prominent physical property is high specific gravity, ranging from 4.3 to 4.7. Moreover, barite has stable chemical properties, is insoluble in water and hydrochloric acid, and is non-magnetic and non-toxic. Barite is mainly used as a mud weighting agent for drilling, accounting for 50% of the drilling mud; in addition, it can be used as a raw material for producing chemical raw materials such as barium oxide, barium carbonate, barium chloride, barium nitrate, precipitated barium sulfate, barium hydroxide and the like. In the paint industry, barite powder fillers can increase the thickness, strength and durability of the paint films; and in the paper-making, rubber and plastic industries, barite is used as a filler to improve the hardness, wear resistance and aging resistance of rubbers and plastics.

A fluorite barite paragenic ore is widely distributed in Sichuan, Chongqing, Guizhou, Shandong, Hunan, etc. in China. It has the following characteristics: firstly, rich reserves and huge resource potential; secondly, centralized distribution and good mining conditions; thirdly, low grade of fluorite, generally $CaF_2$ of less than 25%; fourthly, the ore contains alkaline earth metal salt minerals such as barite and calcite in addition to fluorite, and the content of calcite is generally above 5%, and the sum of the contents of fluorite, barite and calcite is more than 90%. In addition, the cationic particles on the surface of these minerals are all $Ca^{2+}$, $Sr^{2+}$ and $Ba^{2+}$ ions with similar crystalline natures and physicochemical properties, causing interference with each other during the flotation process, and similar floatability causing difficulty in mineral separation for these minerals.

The mining and utilization of such resources are always mainly concentrated on middle-grade ores with a fluorite content of more than 40%, and mainly recovered fluorite, and most of barite mineral in the ore are piled up as tailings. On the other aspect, the beneficiation methods for the recovered fluorite mineral are mainly hand sorting and flotation. Of which, the first choice is that the lump ore containing more than 60% $CaF_2$ is sold to the metallurgical industry enterprises as a flux, and the remaining fine ore is subjected to flotation to obtain refined fluorite powder containing about 94% $CaF_2$. The flotation process adopted is generally a "bulk flotation-separating flotation" process including two times of roughing, three times of scavenging and seven times of clearing. However, the flotation process is complicated, and the bulk flotation of fluorite and barite minerals under alkaline pulp conditions and the separating flotation of fluorite and barite minerals under acidic pulp conditions result in a huge amount of floating mineral, entrainment of impurities and serious mutual inclusion of fluorite and barite. As a result, the fluorite concentrates obtained have a low recovery rate and low product quality, which cannot meet the quality requirements of acid-grade fluorite. At the same time, due to a variety of flotation reagents, the flotation backwater cannot be recycled, resulting in resource waste and environmental pollution.

In Chinese patent document CN200910114165.0, titled as "Low-grade fluorite barite flotation separation method" filed on Jun. 22, 2009, fluorite and barite are processed by a single flotation method, and the flotation reagents include water glass, acidized water glass, sodium sulfate, starch and sodium hexametaphosphate.

Although fluorite and barite can be recovered simultaneously in the above mentioned patent document, the grade of fluorite concentrates is only 95%.

In Chinese patent document CN201510202332.2 titled as "Step-by-step flotation method for separating low-grade calcite-barite-fluorite ore" filed on Jun. 16, 2017, fluorite and barite are also processed by a single flotation method. The desliming flotation (that is, bulk flotation for fluorite and barite) is adopted, flotation agents being sodium carbonate, water glass, and collecting agent CA; then the separating flotation is to inhibit the barite and float the fluorite, to obtain fluorite concentrates, the flotation agents used being aluminum sulfate, sodium lignosulfonate and collecting agent CA; and finally, separating flotation of tailings is performed, and activated carbon, water glass and collecting agent CA are added to float barite, to obtain barite concentrates.

Although both fluorite and barite can be recovered according to the above patent documents, three reagent regimens are used in such processes, and the reagents are various, thereby making the flotation backwater unable to be recycled; and furthermore, the fluorite concentrates obtained by this method have a low grade, only 94% to 98%.

In summary, it is urgent to need a separation method that can reasonably process fluorite barite paragenic ore, especially a lot of low-grade ores with a fluorite content less than 25%, so as to obtain high-quality acid-grade fluorite concentrates ($CaF_2 \geq 98\%$) and barite concentrates and solve the problem that flotation backwater cannot be recycled.

SUMMARY

The object of the present invention is to overcome the shortcomings of the prior art and provide a method for separating a calcite-rich low-grade fluorite barite paragenic ore, to achieve the effects of obtaining high-quality acid-grade fluorite concentrates and barite concentrates and recycling flotation backwater.

The purpose of the present invention is achieved through the following technical solutions: a method for separating a calcite-rich low-grade fluorite barite paragenic ore, including the following steps:

S1, crushing a raw ore to obtain a crushed ore;

S2, performing classification on the crushed ore to obtain a fine-grained ore, a medium-grained ore and a coarse-grained ore;

S3, performing jigging gravity separation on the medium-grained ore and the coarse-grained ore to obtain barite concentrates I and jigging tailings;

S4, performing color sorting on the jigging tailings to obtain calcite minerals and color sorting tailings;

S5, combining the fined-grained ore and the color sorting tailings, and then performing ore grinding to obtain feeding materials in flotation;

S6, performing flotation on the feeding materials in flotation to obtain fluorite concentrates and flotation tailings;

S7, performing chute gravity separation on the flotation tailings to obtain barite concentrates II and chute tailings.

Through the above mentioned technical solution, the barite with good crystallinity is pre-separated by the jigging gravity separation, to greatly reduce the subsequent working difficulty for inhibiting the barite and floating the fluorite, and to achieve the effects of improving the grade of the fluorite concentrates and significantly reducing the usage amount of the inhibitor and the reagent cost. The separation of the calcite by the color sorting greatly reduces the influence of calcite on the fluorite flotation, and achieves the effect of ensuring that the $CaF_2$ content in the fluorite concentrates is more than or equal to 98%.

It should be understood that the method is suitable for common low-grade fluorite barite paragenic ore in China, that is, the percentage by weight of calcite is more than 5%, the percentage by weight of fluorite is less than 25%, and the sum of the percentages by weight of barite, fluorite and calcite is more than 90%; and if the percentage by weight of calcite is less than 5% and the percentage by weight of fluorite is more than 25% in the paragenic ore, higher quality of fluorite concentrates can be obtained in the present invention.

In some implementations, a step of filtering separation is included after jigging gravity separation, flotation, and chute gravity separation, and the water for beneficiation obtained by the filtering separation can be returned to the steps S3 to S4 or/and the steps S6 to S7 for recycling.

Through the above technical solution, only a single reagent regimen is used for flotation of fluorite, while barite is recovered by a gravity separation method, so that the flotation pH value is maintained in a weakly acidic range of 6.5 to 7.0, and the effect of recycling the flotation backwater can be achieved.

In some implementations, the particle size of the fine-grained ore is less than or equal to 1 mm.

In some implementations, the particle size of the crushed ore is less than or equal to 20 mm.

In some implementations, the particle size of the coarse-grained ore is more than 8 mm.

In some implementations, the particle size of the crushed ore is less than or equal to 15 mm.

In some implementations, the particle size of the coarse-grained ore is more than 5 mm.

In some implementations, in the S6, the jigging gravity separation includes the following steps:

1) performing jigging gravity separation on the medium-grained ore to obtain medium-grained concentrates and tailings I;

2) performing jigging gravity separation on the coarse-grained core to obtain coarse-grained concentrates and tailings II;

3) combining the medium-grained concentrates and the coarse-grained concentrates to obtain barite concentrates I; combining the tailings I and the tailings II to obtain jigging tailings.

Through the above technical solution, the particle sizes of the fine-grained ore, medium-grained ore, and coarse-grained ore are defined to achieve the best separation effect of the jigging gravity separation.

In some implementations, the percentage by weight of $BaSO_4$ in the barite concentrates I is more than or equal to 88%, and the percentage by weight of $BaSO_4$ in the barite concentrates II is more than or equal to 90%.

In some implementations, in the S4, the jigging tailings are drained until a water content of less than 5% before proceeding color sorting.

In the above technical solution, the methods of controlling the water content of the jigging tailings include but are not limited to filtering, drying and air drying.

Through the above technical solution, the water content of the jigging tailings is reduced, and the effect of the color sorting can be improved.

In some implementations, in the S5, the percentage by weight of a mineral with a particle size of less than or equal to 0.074 mm in the feeding materials in flotation is 75% to 85%.

Through the above technical solution, the content of minerals with a particle size of less than or equal to 0.074 mm is defined. On one hand, it can prevent the minerals from not being effectively dissociated due to an excessively low content to affect the concentrate grade, and on the other hand, it can prevent ore over-grinding due to an excessively high content to affect the recovery rate of the fluorite concentrates and to increase energy consumption.

In some implementations, in the S6, the flotation includes at least two times of roughing and at least five times of clearing.

In some implementations, in the S6, an inhibitor is added for the flotation; the inhibitor includes acidized water glass, fulvic acid and sodium naphthalene sulfonate; and the collecting agent for the flotation can be chosen according to the prior art, most of which are commercially available oleic acid or sodium oleate.

Through the above technical solution, the acidized water glass, fulvic acid and sodium naphthalene sulfonate selectively inhibit barite, calcite and a small amount of silicate minerals through a synergistic effect. Different from the prior art that requires 6 to 8 times of clearing, the present invention only requires 3 to 5 times of clearing to obtain high-quality acid-grade fluorite concentrates with a $CaF_2$ content of more than or equal to 98%, achieving the effect of improving the flotation efficiency; wherein, the acidized water glass has an inhibitory effect on calcite and silicate minerals, and the fulvic acid and sodium naphthalene sulfonate have an inhibitory effect on the barite, specifically, they can produce strong chemical adsorption to the surface of barite and increase the hydrophilicity of barite, while the adsorbability of barite to the surface of the fluorite is weak, thereby expanding the floatability difference between fluorite and barite to facilitate flotation separation therebetween.

In some implementations, the mass ratio of acidized water glass to fulvic acid to sodium naphthalene sulfonate is (1-2):(1-2):(2-3).

In some implementations, the usage amount of the inhibitor is 1000-2000 g/t•feeding materials in flotation, and the mass concentration of the inhibitor is 1% to 10%.

Through the above technical solution, the amount of the inhibitor is defined to mainly ensure its selective inhibition effect on the ore. If the amount is too low, the inhibitory effect on barite and calcite will be insufficient, and if the amount is too high, it may also produce an inhibitory effect on fluorite.

In some implementations, in the S7, the chute gravity separation includes at least one time of roughing, at least one time of scavenging, and at least one time of clearing.

Beneficial Effects of the Present Invention:

1. For the method for separating a calcite-rich low-grade fluorite barite paragenic ore provided herein, through greatly reducing the subsequent working pressure of inhibiting the fluorite and floating the barite by the jigging gravity separation, the effect of improving the grade of the fluorite concentrates and significantly reducing the usage amount of the inhibitors and the reagent cost is achieved; and through greatly reducing the effect of the calcite on the fluorite flotation by the color sorting, the effect of ensuring that the content of $CaF_2$ in the fluorite concentrates is more than or equal to 98% is achieved.

2. In the method for separating a calcite-rich low-grade fluorite barite paragenic ore provided in the present invention, only a single reagent regimen is used for fluorite flotation, while barite is recovered by the gravity separation method, achieving the effect of recycling the flotation backwater.

3. In the method for separating a calcite-rich low-grade fluorite barite paragenic ore provided in the present invention, the acidized water glass, fulvic acid and sodium naphthalene sulfonate selectively inhibit barite, calcite and a small amount of silicate minerals through a synergistic effect, high-quality acid-grade fluorite concentrates with a $CaF_2$ content of more than or equal to 98% can be obtained by only 3 to 5 times of clearing, achieving the effect of improving the flotation efficiency.

BRIEF DESCRIPTION OF THE DRAWINGS

FIGURE is a flow chart of a method for separating a calcite-rich low-grade fluorite barite paragenic ore according to the present invention.

DETAILED DESCRIPTION OF THE EMBODIMENTS

The technical solutions of the preset invention will be described in detail below, but the protection scope of the present invention is not limited to the following description.

Example 1

A calcite-rich low-grade fluorite barite paragenic ore was provided. The raw ore mainly contained 19.83 wt % $CaF_2$, 63.42 wt % $BaSO_4$ and 7.15 wt % $CaCO_3$. The separation method was shown in the FIGURE and included the following steps:

S1, performing two-stage crushing on a raw ore with a jaw crusher and a cone crusher to obtain a crushed ore with a particle size of less than or equal to 20 mm;

S2, performing classification on the crushed ore to obtain a fine-grained ore with a particle size of less than or equal to 1 mm and a coarse-grained ore with a particle size of more than 8 mm, and the remaining was a medium-grained ore;

S3, performing jigging gravity separation on the medium-grained ore using a fine-grain jigger at a stroke of 10 mm and jig frequency of 320 times/min to obtain medium-grained concentrates and tailings I;

S4, performing jigging gravity separation on the coarse-grained ore using a coarse-grain jigger at a stroke of 15 mm and jig frequency of 350 times/min to obtain coarse-grained concentrates and tailings II;

S5, combining the medium-grained concentrates and coarse-grained concentrates to obtain barite concentrates I containing 90.23 wt % $BaSO_4$, 2.15 wt % $CaF_2$ and 3.11 wt % $CaCO_3$; and combining the tailings I and tailings II to obtain jigging tailings containing 23.83 wt % $CaF_2$, 56.23 wt % $BaSO_4$ and 9.35 wt % $CaCO_3$;

S6, draining the jigging tailings until the water content was less than 5%, and then performing color sorting to obtain calcite minerals containing 32.03 wt % $CaCO_3$, 8.20 wt % $CaF_2$ and 35.35 wt % $BaSO_4$, and color sorting tailings containing 26.77 wt % $CaF_2$, 60.17 wt % $BaSO_4$ and 5.67 wt % $CaCO_3$;

S7, performing combined grinding of the fine-grained ore and color sorting tailings to obtain feeding materials in flotation, wherein the percentage by weight of the minerals with a particle size of less than or equal to 0.074 mm was 82.00%;

S8, adding a 1% calcite and barite inhibitor and a fluorite collecting agent to the feeding materials in flotation for fluorite flotation to obtain fluorite concentrates containing 98.15 wt % $CaF_2$, 0.71 wt % $BaSO_4$ and 0.68 wt % $CaCO_3$, and floatation tailings containing 4.22 wt % $CaF_2$, 78.23 wt % $BaSO_4$ and 6.59 wt % $CaCO_3$, wherein the flotation process included two times of roughing and five times of clearing, the total usage amount of the inhibitor was 1800 g/t•feeding materials in flotation; the calcite and barite inhibitor was a mixture of acidized water glass, fulvic acid and sodium naphthalene sulfonate with a mass ratio of 1:1:2, and the fluorite collecting agent was commercially available oleic acid;

S9, performing chute gravity separation on flotation tailings, with concentration of ore pulp of 25 wt %, to obtain barite concentrates II containing 92.87 wt % $BaSO_4$, 1.57 wt % $CaF_2$ and 2.09 wt % $CaCO_3$, and chute tailings containing 9.58 wt % $CaF_2$, 48.50 wt % $BaSO_4$ and 13.88 wt % $CaCO_3$, wherein the chute gravity separation process included one time of roughing, one time of scavenging and one time of clearing.

Example 2

A calcite-rich low-grade fluorite barite paragenic ore was provided. The raw ore mainly contained 24.36 wt % $CaF_2$, 58.15 wt % $BaSO_4$ and 8.13 wt % $CaCO_3$. The separation method was shown in the FIGURE and included the following steps:

S1, performing two-stage crushing on a raw ore with a jaw crusher and a cone crusher to obtain a crushed ore with a particle size of less than or equal to 15 mm;

S2, performing classification on the crushed ore to obtain a fine-grained ore with a particle size of less than or equal to 1 mm and a coarse-grained ore with a particle size of more than 5 mm, and the remaining was a medium-grained ore;

S3, performing jigging gravity separation on the medium-grained ore using a fine-grain jigger at a stroke of 12 mm and jig frequency of 340 times/min to obtain medium-grained concentrates and tailings I;

S4, performing jigging gravity separation on the coarse-grained ore using a coarse-grain jigger at a stroke of 20 mm and jig frequency of 370 times/min to obtain coarse-grained concentrates and tailings II;

S5, combining the medium-grained concentrates and coarse-grained concentrates to obtain barite concentrates I containing 88.21 wt % $BaSO_4$, 2.85 wt % $CaF_2$ and 3.46 wt % $CaCO_3$; and combining the tailings I and tailings II to obtain jigging tailings containing 29.62 wt % $CaF_2$, 49.37 wt % $BaSO_4$ and 10.32 wt % $CaCO_3$;

S6, draining the jigging tailings until the water content was less than 5%, and then performing color sorting to obtain calcite minerals containing 34.03 wt % $CaCO_3$, 10.02 wt % $CaF_2$ and 28.92 wt % $BaSO_4$, and color sorting tailings containing 33.39 wt % $CaF_2$, 53.31 wt % $BaSO_4$ and 5.76 wt % $CaCO_3$;

S7, performing combined grinding of the fine-grained ore and color sorting tailings to obtain feeding materials in flotation, wherein the percentage by weight of the minerals with a particle size of less than or equal to 0.074 mm was 78.00%;

S8, adding a 3% calcite and barite inhibitor and a fluorite collecting agent to the feeding materials in flotation for fluorite flotation to obtain fluorite concentrates containing 98.56 wt % $CaF_2$, 0.65 wt % $BaSO_4$ and 0.52 wt % $CaCO_3$, and floatation tailings containing 4.06 wt % $CaF_2$, 77.04 wt % $BaSO_4$ and 7.79 wt % $CaCO_3$, wherein the flotation process included two times of roughing and five times of clearing, the total usage amount of the inhibitor was 1200 g/t•feeding materials in flotation; the calcite and barite inhibitor was a mixture of acidized water glass, fulvic acid and sodium naphthalene sulfonate with a mass ratio of 1:1:2, and the fluorite collecting agent was commercially available oleic acid;

S9, performing chute gravity separation on flotation tailings, with concentration of ore pulp of 28 wt %, to obtain barite concentrates II containing 90.12 wt % $BaSO_4$, 2.10 wt % $CaF_2$ and 3.13 wt % $CaCO_3$, and chute tailings containing 8.33 wt % $CaF_2$, 48.50 wt % $BaSO_4$ and 17.97 wt % $CaCO_3$, wherein the chute gravity separation process included one time of roughing, one time of scavenging and two times of clearing.

Example 3

A calcite-rich low-grade fluorite barite paragenic ore was provided. The raw ore mainly contained 22.56 wt % $CaF_2$, 59.35 wt % $BaSO_4$ and 8.65 wt % $CaCO_3$. The separation method was shown in the FIGURE and included the following steps:

S1, performing two-stage crushing on a raw ore with a jaw crusher and a cone crusher to obtain a crushed ore with a particle size of less than or equal to 15 mm;

S2, performing classification on the crushed ore to obtain a fine-grained ore with a particle size of less than or equal to 1 mm and a coarse-grained ore with a particle size of more than 5 mm, and the remaining was a medium-grained ore;

S3, performing jigging gravity separation on the medium-grained ore using a fine-grain jigger at a stroke of 13 mm and jig frequency of 350 times/min to obtain medium-grained concentrates and tailings I;

S4, performing jigging gravity separation on the coarse-grained ore using a coarse-grain jigger at a stroke of 22 mm and jig frequency of 380 times/min to obtain coarse-grained concentrates and tailings II;

S5, combining the medium-grained concentrates and coarse-grained concentrates to obtain barite concentrates I containing 88.65 wt % $BaSO_4$, 2.35 wt % $CaF_2$ and 3.75 wt % $CaCO_3$; and combining the tailings I and tailings II to obtain jigging tailings containing 27.37 wt % $CaF_2$, 50.77 wt % $BaSO_4$ and 11.07 wt % $CaCO_3$;

S6, draining the jigging tailings until the water content was less than 5%, and then performing color sorting to obtain calcite minerals containing 36.12 wt % $CaCO_3$, 8.86 wt % $CaF_2$ and 29.16 wt % $BaSO_4$, and color sorting tailings containing 31.44 wt % $CaF_2$, 55.52 wt % $BaSO_4$ and 5.56 wt % $CaCO_3$;

S7, performing combined grinding of the fine-grained ore and color sorting tailings to obtain feeding materials in flotation, wherein the percentage by weight of the minerals with a particle size of less than or equal to 0.074 mm was 80.00%;

S8, adding a 3% calcite and barite inhibitor and a fluorite collecting agent to the feeding materials in flotation for fluorite flotation to obtain fluorite concentrates containing 98.32 wt % $CaF_2$, 0.69 wt % $BaSO_4$ and 0.58 wt % $CaCO_3$, and floatation tailings containing 4.31 wt % $CaF_2$, 77.92 wt % $BaSO_4$ and 7.38 wt % $CaCO_3$, wherein the flotation process included two times of roughing and five times of clearing, the total usage amount of the inhibitor was 1250 g/t•feeding materials in flotation; the calcite and barite inhibitor was a mixture of acidized water glass, fulvic acid and sodium naphthalene sulfonate with a mass ratio of 1:1:2, and the fluorite collecting agent was commercially available oleic acid;

S9, performing chute gravity separation on flotation tailings, with concentration of ore pulp of 30 wt %, to obtain barite concentrates II containing 90.03 wt % $BaSO_4$, 1.98 wt % $CaF_2$ and 3.01 wt % $CaCO_3$, and chute tailings containing 9.00 wt % $CaF_2$, 53.50 wt % $BaSO_4$ and 16.20 wt % $CaCO_3$, wherein the chute gravity separation process included one time of roughing, one time of scavenging and two times of clearing.

Example 4

A calcite-rich low-grade fluorite barite paragenic ore was provided. The raw ore mainly contained 20.98 wt % $CaF_2$, 60.35 wt % $BaSO_4$, and 5.89 wt % $CaCO_3$. The separation method was shown in the FIGURE and included the following steps:

S1, performing two-stage crushing on a raw ore with a jaw crusher and a cone crusher to obtain a crushed ore with a particle size of less than or equal to 20 mm;

S2, performing classification on the crushed ore to obtain a fine-grained ore with a particle size of less than or equal to 1 mm and a coarse-grained ore with a particle size of more than 8 mm, and the remaining was a medium-grained ore;

S3, performing jigging gravity separation on the medium-grained ore using a fine-grain jigger at a stroke of 15 mm and jig frequency of 350 times/min to obtain medium-grained concentrates and tailings I;

S4, performing jigging gravity separation on the coarse-grained ore using a coarse-grain jigger at a stroke of 20 mm and jig frequency of 400 times/min to obtain coarse-grained concentrates and tailings II;

S5, combining the medium-grained concentrates and coarse-grained concentrates to obtain barite concentrates I containing 89.83 wt % $BaSO_4$, 2.15 wt % $CaF_2$ and 3.41 wt % $CaCO_3$; and combining the tailings I and tailings II to obtain jigging tailings containing 25.60 wt % $CaF_2$, 50.58 wt % $BaSO_4$ and 7.17 wt % $CaCO_3$;

S6, draining the jigging tailings until the water content was less than 5%, and then performing color sorting to obtain calcite minerals containing 25.52 wt % $CaCO_3$, 8.01 wt % $CaF_2$ and 30.58 wt % $BaSO_4$, and color sorting tailings containing 29.57 wt % $CaF_2$, 55.10 wt % $BaSO_4$ and 3.03 wt % $CaCO_3$;

S7, performing combined grinding of the fine-grained ore and color sorting tailings to obtain feeding materials in flotation, wherein the percentage by weight of the minerals with a particle size of less than or equal to 0.074 mm was 82.00%;

S8, adding a 5% calcite and barite inhibitor and a fluorite collecting agent to the feeding materials in flotation for fluorite flotation to obtain fluorite concentrates containing 98.10 wt % $CaF_2$, 0.75 wt % $BaSO_4$ and 0.45 wt % $CaCO_3$, and floatation tailings containing 3.90 wt % $CaF_2$, 76.53 wt % $BaSO_4$ and 4.32 wt % $CaCO_3$, wherein the flotation process included two times of roughing and five times of clearing, the total usage amount of the inhibitor was 1300 g/t•feeding materials in flotation; the calcite and barite inhibitor was a mixture of acidized water glass, fulvic acid and sodium naphthalene sulfonate with a mass ratio of 1:1:2, and the fluorite collecting agent was commercially available oleic acid;

S9, performing chute gravity separation on flotation tailings, with concentration of ore pulp of 32 wt %, to obtain barite concentrates II containing 91.12 wt % $BaSO_4$, 1.76 wt % $CaF_2$ and 2.18 wt % $CaCO_3$, and chute tailings containing 8.31 wt % $CaF_2$, 46.44 wt % $BaSO_4$ and 8.74 wt % $CaCO_3$, wherein the chute gravity separation process included one time of roughing, one time of scavenging and two times of clearing.

Comparative Example 1

The various indicators for separating a calcite-rich low-grade fluorite barite paragenic ore in Example 1 of the present invention were compared with those in Comparative Example 1, wherein the raw ore in Example 1 was used in Comparative Example 1, and the separation method was the technical solution described in Chinese patent CN201510202332.2 (this Comparative Example was compared with the prior art to prove that the separation method of the present invention was more effective).

Comparative Example 2

The various indicators for separating a calcite-rich low-grade fluorite barite paragenic ore in Example 1 of the present invention were compared with those in the Comparative Example 2, wherein the raw ore in Example 1 was used in the Comparative Example 2, and the separation method was as follows: steps S3 to S5 were excluded, and S6 in Example 1 was changed to "directly performing color sorting on the medium-grained ore and the coarse-grained ore, to obtain calcite mineral and color-sorting tailings; and other conditions such as the usage amount of reagents, fineness of grinding and a subsequent technological process, etc. were the same as those in Example 1 of the present invention (this Comparative Example was compared with that with no jigging gravity separation step, to prove that the separation method of the present invention was more effective).

Comparative Example 3

The various indicators for separating a calcite-rich low-grade fluorite barite paragenic ore in Example 1 of the present invention were compared with those in the Comparative Example 3, wherein the raw ore in Example 1 was used in the Comparative Example 3, and the separation method was as follows: step S6 was excluded, and S7 in Example 1 was directly changed to "performing combined grinding of the fine-grained ore and jigging tailings, to obtain feeding materials in flotation"; and other conditions such as the usage amount of reagents, fineness of grinding and a subsequent technological process, etc. were the same as those in Example 1 of the present invention (this Comparative Example was compared with that with no color sorting step, to prove that the separation method of the present invention was more effective).

Comparative Example 4

The various indicators for separating a calcite-rich low-grade fluorite barite paragenic ore in Example 1 of the present invention were compared with those in the Comparative Example 4, wherein the raw ore in Example 1 was used in the Comparative Example 4, and the separation method was as follows: the inhibitor was replaced as dextrin sulfonated phenanthrene, tannic acid, sodium humate, etc. of the prior art; and other conditions such as the usage amount of reagents, fineness of grinding and a subsequent technological process, etc. were the same as those in Example 1 of the present invention (this Comparative Example used the prior art inhibitor, to prove that the inhibitor used in the present invention had more effective separation effect).

Test Effect

1. In order to verify the effect of the separation method of the present invention, the yields, grades and recovery rates of minerals separated from Examples 1 to 4 and Comparative Examples 1 to 4 were tested. The results were shown in the table below.

| | | | Grade | | | Recovery Rate | | |
|---|---|---|---|---|---|---|---|---|
| Group | Product Name | Yield | $CaF_2$ | $BaSO_4$ | $CaCO_3$ | $CaF_2$ | $BaSO_4$ | $CaCO_3$ |
| Example 1 | Fluorite concentrates | 16.64 | 98.15 | 0.71 | 0.68 | 82.36 | 0.19 | 1.58 |
| | Barite concentrates I | 20.15 | 2.15 | 90.23 | 3.11 | 2.18 | 28.67 | 8.76 |
| | Barite concentrates II | 35.59 | 1.57 | 92.87 | 2.09 | 2.82 | 52.12 | 10.4 |

-continued

| Group | Product Name | Yield | Grade | | | Recovery Rate | | |
|---|---|---|---|---|---|---|---|---|
| | | | $CaF_2$ | $BaSO_4$ | $CaCO_3$ | $CaF_2$ | $BaSO_4$ | $CaCO_3$ |
| | Calcite mineral | 10.1 | 8.2 | 35.35 | 32.03 | 4.18 | 5.63 | 45.25 |
| | chute tailings | 17.52 | 9.58 | 48.5 | 13.88 | 8.46 | 13.4 | 34.01 |
| | Raw ore | 100 | 19.83 | 63.42 | 7.15 | 100 | 100 | 100 |
| Example 2 | Fluorite concentrates | 21.08 | 98.56 | 0.65 | 0.52 | 85.29 | 0.24 | 1.35 |
| | Barite concentrates I | 19.88 | 2.85 | 88.21 | 3.46 | 2.33 | 30.16 | 8.46 |
| | Barite concentrates II | 33.35 | 2.1 | 90.12 | 3.13 | 2.88 | 51.69 | 12.84 |
| | Calcite mineral | 10.41 | 10.02 | 28.92 | 34.03 | 4.28 | 5.18 | 43.57 |
| | chute tailings | 15.28 | 8.33 | 48.5 | 17.97 | 5.23 | 12.75 | 33.78 |
| | Raw ore | 100 | 24.36 | 58.15 | 8.13 | 100 | 100 | 100 |
| Example 3 | Fluorite concentrates | 19.28 | 98.32 | 0.69 | 0.58 | 84.01 | 0.22 | 1.29 |
| | Barite concentrates I | 20.23 | 2.35 | 88.65 | 3.75 | 2.11 | 30.10 | 8.77 |
| | Barite concentrates II | 32.73 | 1.98 | 90.03 | 3.01 | 2.87 | 49.46 | 11.39 |
| | Calcite mineral | 11.53 | 8.86 | 29.16 | 36.12 | 4.53 | 5.64 | 48.15 |
| | chute tailings | 16.23 | 9.00 | 53.50 | 16.20 | 6.48 | 14.57 | 30.40 |
| | Raw ore | 100 | 22.56 | 59.58 | 8.65 | 100.00 | 100.00 | 100.00 |
| Example 4 | Fluorite concentrates | 18.02 | 98.10 | 0.75 | 0.45 | 84.25 | 0.22 | 1.38 |
| | Barite concentrates I | 21.05 | 2.15 | 89.83 | 3.41 | 2.16 | 31.33 | 12.19 |
| | Barite concentrates II | 33.23 | 1.76 | 91.12 | 2.18 | 2.79 | 50.17 | 12.30 |
| | Calcite mineral | 11.59 | 8.01 | 30.58 | 25.52 | 4.43 | 5.87 | 50.23 |
| | chute tailings | 16.11 | 8.31 | 46.44 | 8.74 | 6.38 | 12.40 | 23.91 |
| | Raw ore | 18.02 | 20.98 | 60.35 | 5.89 | 100.00 | 100.00 | 100.00 |
| Comparative Example 1 | Fluorite concentrates | 16.95 | 95.89 | 1.150 | 1.68 | 82.17 | 0.31 | 3.90 |
| | Barite concentrates | 55.79 | 3.21 | 89.950 | 3.56 | 9.05 | 79.00 | 27.21 |
| | Calcite mineral | 27.26 | 6.37 | 48.21 | 18.45 | 8.78 | 20.69 | 68.89 |
| | Raw ore | 100 | 19.78 | 63.520 | 7.30 | 100.00 | 100.00 | 100.00 |
| Comparative Example 2 | Fluorite concentrates | 16.35 | 97.45 | 0.950 | 0.71 | 81.08 | 0.24 | 1.59 |
| | Barite concentrates | 45.82 | 2.18 | 90.120 | 3.08 | 5.08 | 64.63 | 19.33 |
| | Calcite mineral | 13.23 | 8.51 | 38.190 | 30.25 | 5.73 | 7.91 | 54.82 |
| | chute tailings | 24.60 | 6.47 | 70.69 | 7.20 | 8.10 | 27.22 | 24.25 |
| | Raw ore | 100 | 19.65 | 63.890 | 7.30 | 100.00 | 100.00 | 100.00 |
| Comparative Example 3 | Fluorite concentrates | 16.43 | 96.15 | 0.680 | 1.85 | 81.57 | 0.17 | 4.17 |
| | Barite concentrates I | 20.08 | 2.52 | 90.520 | 3.15 | 2.63 | 28.59 | 8.72 |
| | Barite concentrates II | 36.13 | 2.05 | 91.890 | 3.52 | 3.85 | 52.22 | 17.54 |
| | chute tailings | 27.45 | 8.39 | 44.05 | 18.37 | 11.95 | 19.02 | 69.56 |
| | Raw ore | 100 | 19.26 | 63.580 | 7.25 | 100.00 | 100.00 | 100.00 |
| Comparative Example 4 | Fluorite concentrates | 16.38 | 96.18 | 1.320 | 1.25 | 79.09 | 0.34 | 2.70 |
| | Barite concentrates I | 19.95 | 2.01 | 90.930 | 2.98 | 2.01 | 28.80 | 7.84 |
| | Barite concentrates II | 36.02 | 1.85 | 92.380 | 2.55 | 3.35 | 52.83 | 12.12 |
| | Calcite mineral | 10.25 | 8.32 | 35.120 | 32.59 | 4.28 | 5.72 | 44.07 |
| | chute tailings | 17.40 | 12.91 | 44.53 | 14.49 | 11.27 | 12.30 | 33.27 |
| | Raw ore | 100 | 19.92 | 62.980 | 7.58 | 100.00 | 100.00 | 100.00 |

As shown from the above table, in the Comparative Example 1, as compared with Example 1, the yield of fluorite concentrates has no significant change, but the grade and recovery rate of $CaF_2$ thereof are significantly reduced; and the yield of barite concentrates have no significant change, but the grade and recovery rate of $BaSO_4$ are significantly reduced.

In Comparative Example 2, the yield of fluorite concentrates has no significant change, but the grade and recovery rate of $CaF_2$ thereof are significantly reduced; and the yield of barite concentrates, the grade and recovery rate of $BaSO_4$ are significantly reduced, indicating that the jigging gravity separation could improve the grade and recovery rate of $CaF_2$ in the fluorite concentrates, the yield of barite concentrates and the grade and recovery rate of $BaSO_4$ therein.

In Comparative Example 3, the yield of fluorite concentrates has no significant change, but the grade and recovery rate of $CaF_2$ thereof are significantly reduced; and the yield of barite concentrates and the recovery rate of $BaSO_4$ are significantly reduced, while the grade of $BaSO_4$ has no significant change, indicating that the color sorting could improve the grade and recovery rate of $CaF_2$ in the fluorite concentrates, the yield of barite concentrates and the recovery rate of $BaSO_4$ therein.

In Comparative Example 4, the yield of fluorite concentrates has no significant change, but the grade and recovery rate of $CaF_2$ thereof are significantly reduced; and the yield of barite concentrates, the grade and recovery rate of $BaSO_4$ have no significant change, indicating that the inhibitor of the present invention could improve the grade and recovery rate of $CaF_2$ in the fluorite concentrates.

2. In order to verify the effect of recycling of water for beneficiation of the present invention, a comparative test was carried out. The test included an experimental group, a control group A and a control group B, wherein the yields, grade of $CaF_2$ and recovery rate of $CaF_2$ of the feeding materials in flotation, the obtained fluorite concentrates and the flotation tailings were tested respectively; wherein, in the experimental group, the water for beneficiation obtained in Example 1 was used for flotation separation, in the control group A, clear water was used for flotation separation, and in the control group B, the water for beneficiation obtained in the Comparative Example 1 was used for flotation separation. The flotation separation method was the same as that of Example 1. The results are shown in the table below.

| Group | Product Name | Yield | Grade of $CaF_2$ | Recovery Rate of $CaF_2$ |
|---|---|---|---|---|
| Experimental group | Fluorite concentrates | 29.68 | 98.1 | 90.96 |
| | Flotation tailings | 70.32 | 4.11 | 9.04 |
| | Flotation feed | 100.00 | 32.01 | 100.00 |
| Control group A | Fluorite concentrates | 28.78 | 98.52 | 90.41 |
| | Flotation tailings | 71.22 | 4.22 | 9.59 |
| | Flotation feed | 100.00 | 31.36 | 100.00 |
| Control group B | Fluorite concentrates | 28.65 | 95.38 | 83.87 |
| | Flotation tailings | 71.35 | 7.20 | 16.13 |
| | Flotation feed | 100.00 | 32.58 | 100.00 |

As shown in the above table, as compared with control group A, the yield of fluorite concentrates, and the grade and recovery rate of $CaF_2$ obtained in the experimental group have no significant change; in the control group B, the yield of the obtained fluorite concentrates has no significant change, but the grade and recovery rate of $CaF_2$ therein are reduced significantly. Therefore, the recycling of the water for beneficiation in the prior art would significantly reduce the grade and recovery rate of $CaF_2$ in the fluorite concentrates; however, the water for beneficiation in the present invention could be recycled, and effect thereof is not significantly different from that of clear water.

In summary, by the method for separating a calcite-rich low-grade fluorite barite paragenic ore of the present invention, high-quality acid-grade fluorite concentrates and barite concentrates can be obtained, and the flotation backwater can be recycled.

The foregoing description only describes the preferred embodiments of the present invention. It should be understood that the present invention is not limited to the form disclosed herein, and should not be regarded as an exclusion of other embodiments, but can be used in various other combination, modification and environment. The description can be modified through the above teaching or technology or knowledge in related fields within the scope of the concept described herein. The modification and change without departing from the spirit and scope of the present invention made by those skilled in the art should fall within the scope of protection of the appended claims of the present invention.

What is claimed is:

1. A method for separating a calcite-rich low-grade fluorite barite paragenic ore, comprising the following steps:

S1, crushing a raw ore to obtain a crushed ore;

S2, performing a classification on the crushed ore to obtain a fine-grained ore, a medium-grained ore and a coarse-grained ore;

S3, performing a jigging gravity separation on the medium-grained ore and the coarse-grained ore to obtain first barite concentrates and jigging tailings;

S4, performing a color sorting on the jigging tailings to obtain calcite minerals and color sorting tailings;

S5, combining the fine-grained ore and the color sorting tailings, and then performing an ore grinding to obtain feeding materials in flotation;

S6, performing a flotation on the feeding materials in flotation to obtain fluorite concentrates and flotation tailings;

S7, performing a chute gravity separation on the flotation tailings to obtain second barite concentrates and chute tailings.

2. The method according to claim 1, wherein a particle size of the fine-grained ore is less than or equal to 1 mm.

3. The method according to claim 2, wherein a particle size of the crushed ore is less than or equal to 20 mm.

4. The method according to claim 3, wherein a particle size of the coarse-grained ore is more than 8 mm.

5. The method according to claim 2, wherein a particle size of the crushed ore is less than or equal to 15 mm.

6. The method according to claim 5, wherein a particle size of the coarse-grained ore is more than 5 mm.

7. The method according to claim 1, in the S6, the jigging gravity separation comprises the following steps:

1) Performing the jigging gravity separation on the medium-grained ore to obtain medium-grained concentrates and first tailings;

2) Performing the jigging gravity separation on the coarse-grained core to obtain coarse-grained concentrates and second tailings;

3) Combining the medium-grained concentrates and the coarse-grained concentrates to obtain the first barite concentrates; combining the first tailings and the second tailings to obtain the jigging tailings.

8. The method according to claim 1, wherein in the S4, the jigging tailings are drained until a water content of less than 5% before proceeding the color sorting.

9. The method according to claim 1, wherein in the S5, a percentage by weight of a mineral with a particle size of less than or equal to 0.074 mm in the feeding materials in flotation is 75% to 85%.

10. The method according to claim 1, wherein in the S6, the flotation comprises at least two times of roughing and at least five times of clearing.

11. The method according to claim 1, wherein in the S6, an inhibitor is added for the flotation; the inhibitor comprises acidized water glass, fulvic acid and sodium naphthalene sulfonate.

12. The method according to claim 11, wherein a mass ratio of the acidized water glass to the fulvic acid to the sodium naphthalene sulfonate is (1-2):(1-2):(2-3).

13. The method according to claim 11, wherein a usage amount of the inhibitor is 1000-2000 g/t•feeding materials in flotation.

14. The method according to claim 1, wherein in the S7, the chute gravity separation comprises at least one time of roughing, at least one time of scavenging, and at least one time of clearing.

15. The method according to claim 12, wherein a usage amount of the inhibitor is 1000-2000 g/t•feeding materials in flotation.

* * * * *